United States Patent [19]

Tetenborg et al.

[11] Patent Number: 4,537,013

[45] Date of Patent: Aug. 27, 1985

[54] BAG-FILLING APPARATUS

[75] Inventors: Konrad Tetenborg; Heinz Eschmann, both of Lengerich, Fed. Rep. of Germany

[73] Assignee: Windmoller & Holscher, Lengerich, Fed. Rep. of Germany

[21] Appl. No.: 442,286

[22] Filed: Nov. 17, 1982

[30] Foreign Application Priority Data

Nov. 23, 1981 [DE] Fed. Rep. of Germany ..... 3146319

[51] Int. Cl.[3] ..... B65B 39/02; B65B 39/04; B65B 43/30

[52] U.S. Cl. ..... 53/570; 53/261; 53/384; 53/386; 141/93; 141/114; 141/317

[58] Field of Search ..... 53/260, 261, 384, 385, 53/386, 570, 571, 572, 573; 141/10, 59, 67, 68, 93, 114, 165, 166, 285, 310, 313, 314, 317

[56] References Cited

U.S. PATENT DOCUMENTS

| | | | |
|---|---|---|---|
| 2,853,842 | 9/1958 | Vredenburg | 53/384 |
| 2,973,612 | 3/1961 | McGowan | 53/384 |
| 3,138,907 | 6/1964 | Gerbe | 53/385 |
| 3,384,134 | 5/1968 | Hillerns | 141/314 |
| 3,750,721 | 8/1973 | Hudson | 141/317 X |
| 3,830,266 | 8/1974 | Hudson | 141/10 |
| 3,948,019 | 4/1976 | Döring et al. | 53/385 X |
| 4,061,221 | 12/1977 | Higashinaka et al. | 141/93 X |

FOREIGN PATENT DOCUMENTS

| | | |
|---|---|---|
| 2629065 | 4/1979 | Fed. Rep. of Germany . |
| 2850668 | 5/1980 | Fed. Rep. of Germany . |
| 1566640 | 5/1977 | United Kingdom . |

*Primary Examiner*—Robert L. Spruill
*Assistant Examiner*—Michael D. Folkerts
*Attorney, Agent, or Firm*—Fleit, Jacobson, Cohn & Price

[57] ABSTRACT

Bag-filling apparatus comprises gripping means for gripping flat bags adjacent to their top edges and side edges, vacuum cups for engaging the bag on opposite sides near its top edges and for pulling said top edges apart, and a filling pipe, which is provided with filling hopper halves, which are adapted to be pivotally movable about parallel axes by drive means. The filling hopper halves are hinged on respective axes which are transverse to the line which connects the grippers and the spreading members of the filling hopper halves have in cross-section laterally inverted, outwardly protruding or convex shapes the apices of which are disposed on the line which connects the grippers. The arrangement may be such that the end edges and side walls of the filling hopper halves are in sealing contact with each other when the filling hopper halves are in their swung-in position.

5 Claims, 3 Drawing Figures

BAG-FILLING APPARATUS

Figure 1:
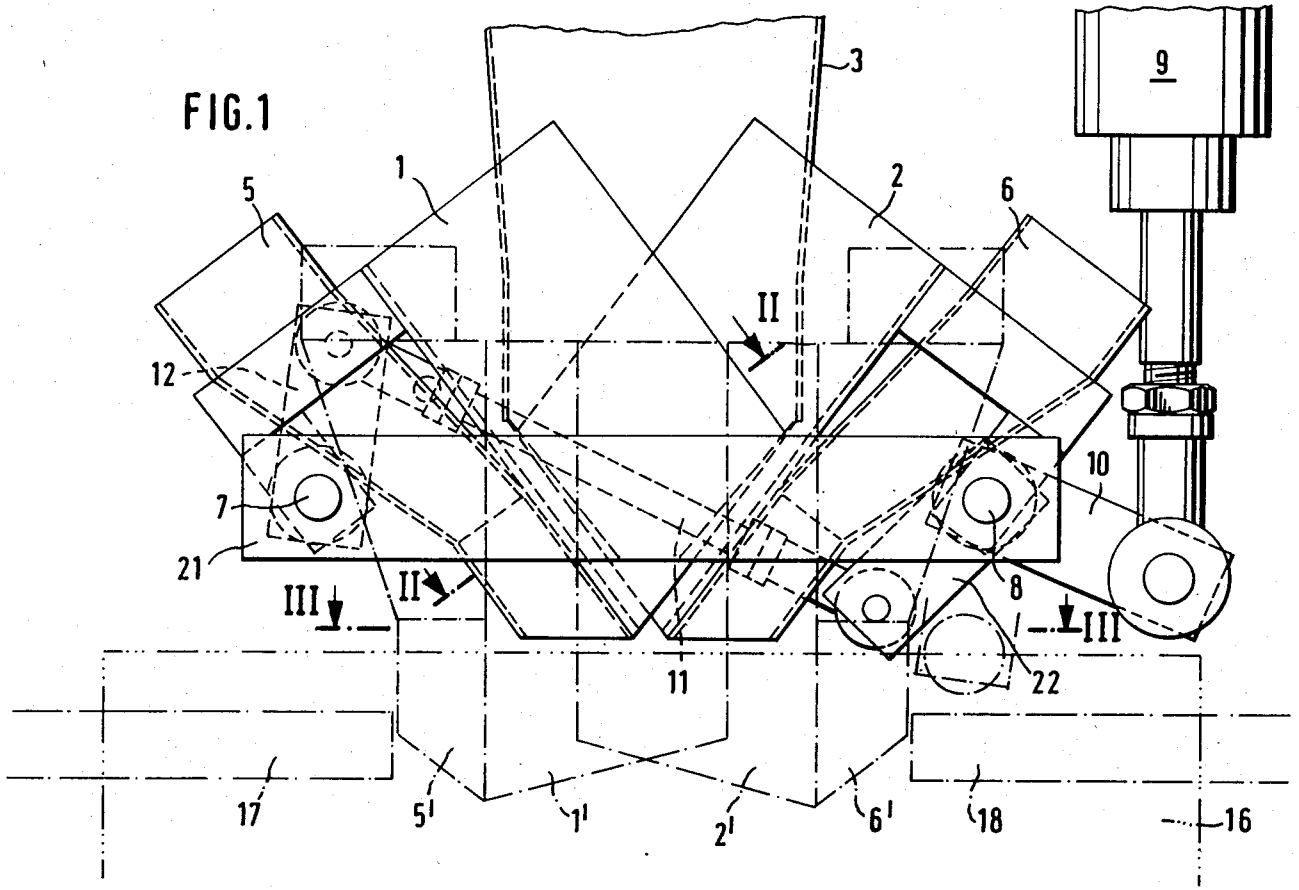

This invention relates to bag-filling apparatus comprising gripping means for gripping flat bags adjacent to their top edges and side edges, vacuum cups for engaging the bag on opposite sides near its top edges and for pulling said top edges apart, and a filling pipe, which is provided with filling hopper halves, which are adapted to be pivotally movable about parallel axes by drive means.

German Patent Specification No. 26 29 065 discloses apparatus of that kind in which the still flat bags are gripped adjacent to their side edges by two mutually opposite, tonglike grippers and the vacuum cups are then actuated to pull the top edges of the bag apart. The filling hopper halves are hinged on axes which are transverse to the pulling direction, i.e., to the line connecting the grippers. When the filling hopper halves have been spread apart, passages which are approximately triangular in cross-section inevitably remain between the spreading members and the grippers and dust can escape through said passages during the filling operation.

Laid-open German Application No. 28 50 668 discloses bag-filling apparatus which comprises filling hopper halves that can be spread apart and in which an escape of dust during the filling operation is avoided by the provision of a vacuum pipe, which concentrically surrounds the filling pipe, so that dust can be sucked off through the annular passage left between the filling pipe and vacuum pipe. An ingress of air between the side walls of the filling hopper halves is prevented by elastic webs, which are secured to the filling hopper halves and are under tension. But that known apparatus cannot prevent an escape of dust from the openings between the outside surfaces of the spread filling hopper halves and the top edges of the bag to be filled, which top edges are clamped against said filling hopper halves.

It is an object of the invention to provide bag-filling apparatus which is of the kind described first hereinbefore and can be used to fill bags substantially without an escape of dust.

In apparatus of the kind described first hereinbefore, that object is accomplished in that the filling hopper halves are hinged on respective axes which are transverse to the line which connects the grippers and the spreading members of the filling hopper halves have in cross-section laterally inverted, outwardly protruding or convex shapes the apices of which are disposed on the line which connects the grippers.

In the apparatus according to the invention, the profiled spreading members can sealingly engage the edge of the bag adjacent to the grippers when that edge has been spread by the filling hopper halves. As a result, the cross-section of the opening defined by the spread apart filling hopper halves will match the cross-section of the spread opening of the bag. The usually tonglike grippers are spaced a fixed distance apart as they engage the bag so that the bag opening held open by the filling hopper halves will have the same size even in bags differing in width. Because the filling hopper halves when spread apart are in snug contact with the inside surface of the bag at the bag opening when the latter is held open, there will be no passages left through which dust could undesirably escape. As the gripping tongs grip the bag to be filled at its opening near the side edges of the bag, the apparatus according to the invention may be used to fill bags having side gussets just as to fill bags having no side gussets.

The spreading members may be substantially circular or elliptic shape in cross-section or may be defined by the legs of an isosceles triangle. Spreading members having such shapes can be pivotally moved closely to the grippers without giving rise to excessively high stresses in the edge portion of the bag which is held open.

Within the scope of the invention, the side edges of the profiled spreading members may be connected to sheet metal elements which belong to the filling hopper halves and are parallel to the hinge axes and define passages with the profiled spreading members. These passages may be covered so that an escape of dust will be prevented, or they may be connected to vacuum ducts through which dust can then be sucked off during the filling operation.

Within the scope of the invention, side walls which are parallel to the planes in which the filling hopper halves are pivotally movable may be provided at the side edges of the spreading members and these side walls may be arranged to overlap throughout their height when the filling hopper halves are swung apart. This arrangement will ensure that no clearances through which dust could escape will be left between the spread apart filling hopper halves. During the spreading operation, the vacuum cups will release the edge of the bag so that said edge can snugly contact the spread apart filling hopper halves.

Also within the scope of the invention, the end edges and side walls of the filling hopper halves are in sealing contact with each other when the filling hopper halves have been swung in. With that arrangement, the filling hopper halves can be used as hinged closures for the filling pipe so that the filling of the gripped bag can succeed the spreading apart of the filling hopper halves without delay. In that case the filling hopper halves constitute also a closure, which will be of advantage particularly when a bag fails to arrive and an escape of filling material into the filling apparatus is to be prevented.

The filling rate can be substantially increased if the filling of the gripped bag can be initiated as soon as the filling hopper halves have been spread apart and it is not necessary to wait after the spreading of the filling hopper halves until the feed passage leading to the filling pipe has been cleared.

Figure 2:
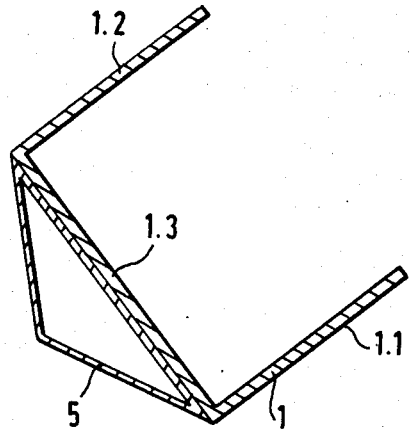
Figure 3:
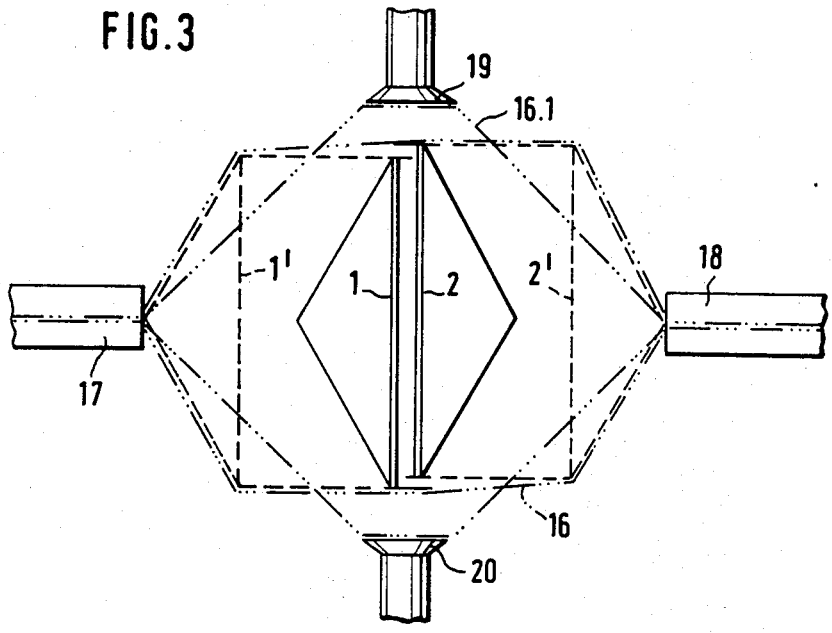

An illustrative embodiment of the invention will now be described more in detail with reference to the drawing, in which FIG. 1 is a side elevation showing the filling hopper, FIG. 2 is a sectional view taken on line II—II in FIG. 1 and showing one filling hopper half and FIG. 3 is a sectional view taken on line III—III in FIG. 1.

Adjacent to the lower end of the filling pipe 3, the two filling hopper halves, 1, 2 are hinged on parallel horizontal shafts 7, 8 to a bracket 21, which may be secured to the filling pipe or to a frame. The two filling hopper halves 1, 2 are substantially channel-shaped in cross-section and are laterally inverted. The cross-section of the filling hopper half 1 is apparent from FIG. 1. The side walls 1.1 and 1.2 of the filling hopper half 1 overlap the corresponding side walls of the other filling hopper half 2 in part when the filling hopper halves 1, 2 have been swung in and overlap them throughout their height when the filling hopper halves have been spread apart. This is shown in FIG. 1 with solid and dash-dot lines, respectively.

Vacuum pipes 5, 6 are secured to the rear walls 1.3 of the filling hopper halves 1, 2 and in their lower portion, which extends into the bags to be filled, have in cross-section the shape of an isosceles triangle. The base length of that isosceles triangle is equal to the width of the rear wall of the filling hopper halves 1, 2. The vacuum pipes 5, 6 which are triangular in cross-section are connected to the lower portion of the associated filling hopper half. Each of the vacuum pipes 5, 6 has above that portion which is triangular in cross-section, a portion which has a different cross-section and is connected to a vacuum pump by flexible tubing, which is not shown.

A lever 10 is non-rotatably connected to the shaft 8 by which the filling hopper half 2 is hinged to the bracket 21. The piston rod of a pneumatic cylinder 9 is pivoted to the free end of the lever 10 so that the pneumatic cylinder 9 can be actuated to impart a pivotal movement to the filling funnel half 2. That pivotal movement is transmitted to the other filling funnel half 1 by another lever 22, which is secured to the shaft 8 and extends at an angle to the lever 10, and by a link 11, which is pivoted at one end to the free end of the lever 22 and at its other end to the free end of the lever 12, which is secured to the shaft 7 for imparting a pivotal movement to the filling hopper half 1. It is apparent that the pneumatic cylinder 9 can be actuated to impart a pivotal movement to both filling hopper halves 1, 2 between their swung-in position, indicated by solid lines, and their swung-out or filling position indicated by dash-dot lines at 1', 2', 5', 6'.

FIG. 3 is a sectional view taken on line III—III of FIG. 1 and diagrammatically shows the filling funnel halves in their swung-in position 1, 2 and their swung-out position 1', 2'. The grippers 17, 18, which are diagrammatically indicated only by their gripping jaws, grip the side walls of a bag 16 near its top opening. These side walls form gussets on the side edges of the bag. When the grippers 17, 18 have been moved toward each other to the positions shown in FIGS. 1 and 3, the opening of the bag is spread open as is indicated by line 16.1 by means of vacuum cups 19, 20, which are applied to the central portions of the side edge portions of the bag near the top opening thereof. When the bag has been opened by means of the vacuum cups 19, 20, the pneumatic cylinder 9 is actuated to move the lower ends of the filling funnel halves 1, 2 from the position shown in solid lines in FIG. 3 to position 1',2'. The vacuum cups 19, 20 are then disconnected from the vacuum source so that the filling hopper halves pull the top edges of the bag apart as is apparent from FIG. 3.

When the filling hopper halves are in the filling position 1', 2' and the bag is gripped at its top opening by the grippers 17, 18, the top edge of the bag will be tensioned so that no dust can escape on the sides. During the filling of the bag, any dust raised from the material being filled will be sucked off.

What is claimed is:

1. Bag filling apparatus comprising:

(a) a filling pipe having an axis and a filling outlet;

(b) a pair of opposed filling hopper halves positioned about the filling pipe and adjacent the filling outlet, said filling hopper halves pivotally supported for movement about respective spaced, parallel pivot axes, said filler hopper halves having lower portions defining spreading members adapted to engage the upper, inner surfaces of a bag;

(c) drive means for pivotally moving said filling hopper halves from a first position in which said spreader members are in an inward position to prevent flow of material into a bag positioned below said filling outlet, to a second position in which said spreader members are in an outward position to permit flow of material into a bag positioned below said filling outlet;

(d) opposed gripping means positioned below said filling pipe and on opposite sides of the axis thereof, said opposed gripping means lying on a line transverse to said pivot axes, said gripping means adapted to grip flat bags adjacent to their top edges and along side edges thereof and spaced a predetermined fixed distance from each other and on opposite edges of a bag, the spacing between said gripping means being less than the width of the bag to be gripped and sufficient to provide an ungripped portion of the bag which when opened defines an opening having an inner periphery that is substantially equal to the outer periphery of said filling hopper halves when in said second position, to prevent escape of product dust during filling of the bag;

(e) opposed vacuum cups for engaging the bag on opposite outer sides and adjacent the top edges thereof, said opposed vacuum cups lying on a line substantially perpendicular to and substantially equidistant from the line on which said gripping means lie and movable away from the bag to draw the sides thereof apart to provide a filling opening;

(f) said drive means being operative to pivot said filling hopper halves into the second position so that they act against inner surfaces of drawn-apart sides of the bag after release of vacuum from the vacuum cups, to provide a bag opening of uniform size independent of bag widths that are greater than the spacing between the opposed gripping means; and (g) said spreading members including outwardly protruding end walls, the outmost points of which lie on a line connecting said gripping means, each of said filler hopper halves having side walls that extend toward the opposite filler hopper half, the side walls overlapping each other in a direction along the axis of the filling pipe when the filling hopper halves are in the second position to prevent the escape of dust therebetween.

2. Apparatus according to claim 1, wherein the outwardly protruding walls of the spreading members are curved.

3. Apparatus according to claim 1, wherein the outwardly protruding walls of the spreading members define an isosceles triangle in cross-section.

4. Apparatus according to claim 1, wherein the spreading members have side edges, and the filling hopper halves include plates that are parallel to the pivot axes, the side edges of the plates defining passages that extend along the spreading members for connection with a source of vacuum to suck away product dust during filling of the bag.

5. Apparatus according to claim 1, wherein the filling hopper halves each have a pair of opposed parallel side walls on respective opposite sides of the filling pipe, the side walls being positioned parallel to a plane in which the filling hopper halves are pivotally movable and extending from side edges of the spreading members, the respective side walls of the filling hopper halves overlapping each other when the filling hopper halves are in the second position to prevent escape of dust when the bag is being filled.

* * * * *